US005632691A

United States Patent [19]

Hannon et al.

[11] Patent Number: 5,632,691

[45] **Date of Patent: *May 27, 1997**

[54] GOLF PUTTER

[75] Inventors: Richard H. Hannon, Oceanside; Carl T. Wagner, Encinitas, both of Calif.

[73] Assignee: Golfology, Inc., Carlsbad, Calif.

[ * ] Notice: The term of this patent shall not extend beyond the expiration date of Pat. No. 5,554,078.

[21] Appl. No.: 589,499

[22] Filed: Jan. 22, 1996

Related U.S. Application Data

[63] Continuation-in-part of Ser. No. 415,137, Mar. 31, 1995, Pat. No. 5,554,078.

[51] Int. Cl.[6] ..... A63B 53/00

[52] U.S. Cl. ..... 473/292; 473/297

[58] Field of Search ..... 473/256, 292, 473/297, 291

[56] References Cited

U.S. PATENT DOCUMENTS

| | | | |
|---|---|---|---|
| 2,051,083 | 8/1936 | Hart | 473/297 |
| 3,231,281 | 1/1966 | Wallo | 473/256 |
| 4,415,156 | 11/1983 | Jorgensen | 473/291 |
| 5,152,527 | 10/1992 | Mather et al. | 473/297 X |
| 5,269,518 | 12/1993 | Kobayashi et al. | 473/297 |
| 5,364,102 | 11/1994 | Appledorn | 473/297 |

*Primary Examiner*—George J. Marlo
*Attorney, Agent, or Firm*—Frank G. Morkunas

[57] ABSTRACT

A golf putter with a shaft having an inner chamber, a butt-end, and a tip, a grip attached to the butt-end of the shaft, a weight in the shaft having a predetermined center point along the shaft, with that center point positioned along the shaft between 20 and 71.4 length % from the butt-end relative to an overall length of the golf putter, and a putter head connected to the tip of the shaft, with the putter head bearing a weight ratio to the shaft weight ranging between 0.56:1 and 3.20:1 and a shaft weight ratio to an overall weight of the golf putter ranging between 0.30:1 and 0.55:1, which after all elements are connected and attached presents a specific balance point for the golf putter ranging between 45.71 and 69.29 length % from the butt-end relative to the overall length of the golf putter and a swingweight between D-6 and negative E-9.

18 Claims, 1 Drawing Sheet

GOLF PUTTER

CROSS-REFERENCE TO RELATED APPLICATIONS

This application is a continuation-in-part of our U.S. patent application Ser. No. 08/415,137 filed on Mar. 31, 1995, now U.S. Pat. No. 5,554,078.

BACKGROUND OF THE INVENTION

This invention relates to a golf putter, more specifically to a golf putter specially weighted in such a manner as to maintain the wrists in a locked state (wrist-lock potential) and maintains some head control when initiating and completing a putt.

Approximately 40–60% of all golf play occurs on the green and involves the use of a golf putter. Consequently, putting is a critical part of the game. Mastering the art of putting projects a golfer into a higher caliber of play. The best putt is one in which the stroke is smooth, fluid, un-interrupted, free of twitch and quit, and is on line with the intended targets; the ball and the hole. Golf putters basically consist of a shaft, a putter head on one end (tip) of the shaft, and a butt-end having a grip on the other end of the shaft; the butt-end being furthest away from the putter head.

There are three basic putting styles; (1) the pendulum stroke, (2) the cocked-wrist stroke, and (3) the wrist strike. The first two are the most common and used by the vast majority of golfers; amateur and professional alike. Each of the two common styles use the shoulders as the focal point and force behind the stroke. The arms, wrists, and hands are, and remain locked, throughout the stroke. The ball is "pushed" rather than struck. The stroke must be smooth, fluid, and un-interrupted, free of twitch (jerky stroke) and quit (minute disruptions to the stroke). On a vertical plane, the putter head should not pass beyond the golfer's hands. The wrists in particular should remain locked in position as any movement in the wrists is magnified in reaction at the putter head. The only difference between these two styles is the hand-wrist positions and shaft alignment with respect to the shoulders. In the pendulum style, the arms from the shoulders downward form a "V"; the wrists are in line with the arms. The shaft of the golf putter substantially bisects the "V" and is in substantial straight-line alignment from the putter head to the shoulders. By this alignment, the shaft becomes a long lever artificially extended from butt-end of the shaft to the focal point of the stroke. The shoulders as the fulcrum push the stroke through to the ball.

In the wrist-cock style, the arms at the elbows are straight, but the wrists and hands are locked in a slightly cocked position. The shaft of the golf putter is thereby slightly angled in relation to the bisection point of the"V" described above. In this style, the shoulder also acts as the focal point and fulcrum to push the stroke through to the ball. The wrists should remain locked in their cocked position. As with the pendulum style, the arms, in locked fashion, move in tandem with the shoulders. The hands attempt to hold the golf putter steady for the duration of the stroke. In all styles, a heavier head (in relation to the overall weight of the putter) causes the head to accelerate prior to impact with a ball. This is commonly referred to as "releasing the head" or, as used herein, "head control".

The last style is the least used; mostly by beginners. In this style, the wrists rather than the shoulders provide the driving force to swing rather than to stroke the golf putter. The wrists unlock and become the pivot point of the swing. The ball is struck rather than stroked and, on a vertical plane, the putter head swings past the hands. In all styles, a heavier putter head in relation to the overall weight of the putter causes the head to self-accelerate prior to impact thereby decreasing the golfer's control of the putt. this is commonly referred to as 'releasing the head, or as used herein, 'head control'.

From the bottom of the putter head to the butt-end of the shaft, golf putters generally range from 30 to 40 inches in overall length. Of this overall length, the shaft comprises between 30 to 34 inches and can be inserted directly into the putter head or by way of a hosel. Conventional golf putters weigh generally between 450 and 520 grams. Of this weight, the putter head comprises between 300 and 340 grams, the shaft between 85 and 95 grams, the grip between 60 and 70 grams, and miscellaneous matter between 5 and 15 grams. As clearly seen, the putter head encompasses roughly two-thirds of the entire weight of the golf putter. Relative weight distribution among golf putters is approximately the same.

A typical conventional golf putter is about 35 inches in length, has a 32 inch shaft, and weighs approximately 485 grams. Of that weight, the putter head encompasses about 320 grams, the shaft about 90 grams, the grip about 65 grams, and miscellaneous matter about 10 grams. The balance point of this typical conventional golf putter (i.e., the point on the golf putter at which it perfectly balances) is about 9 inches from the putter head and 26 inches from the butt-end (or roughly 74.3 length % from the butt-end).

Swingweight is yet another important variable associated with golf clubs (woods and irons primarily) and is used to properly fit a club for its intended use. Swingweight is determined by measuring a club's overall weight distribution about a fulcrum point established at a specified distance (either 12 or 14 inches depending on the type of scale being used and the measurement interpretation) from the butt-end of the club and the balance point of the club. A 14-inch fulcrum scale (referred to as a Lorythmic or Prorythmic scale) is typically used by club manufacturers while a 12-inch fulcrum scale (referred to as an Official scale) is used typically by repair shops. The Prorythmic scales measure swingweight by assigning alpha-numeric characters to the weight; i.e., A through H as the prime characters with 10 numeric increments between each successive alpha-character increase (e.g., A-0, A-1, A-2 . . . A-9, B-0, and so on). An A-0 reading is a light swingweight equating to a swingweight of 650 grams. An H-0 reading is the highest on the Prorythmic scale and equates to a swingweight of 1120 grams. The swingweight of a typical conventional golf putter (i.e., 485 grams in overall weight, 35 inches in overall length, having a balance point 26 inches from the butt-end) is D-0; or a swingweight of 850 grams.

The further the putter head is from the focal point of the stroke, the more difficult it is to execute a successful putt. Conversely, the closer it is to the focal point of the stroke, the less difficult it is to execute a successful putt. In the conventional golf putter, with the focal point (shoulders) of the lever at such a distance from where the mass and weight of the golf putter are concentrated (putter head), the golfer faces a difficult task in attempting to firmly support the golf putter and keep the wrists unflinchingly locked during the critical moments of putting. The reason for this difficulty is that the hands grip the golf putter at a distance of between 32 and 35 inches from the bottom of the putter head and, depending on the length of the golfer's arm, between 20 and 28 inches from the focal point (shoulders) of the stroke. The golf putter, although relatively light, bears a heavy swingweight which, because of this weight, fosters rather than inhibits unwanted movement. Attaining and maintaining wrist-lock potential and a movement-free stroke in this weight-to-distribution environment, therefore, is extremely difficult.

With the concentration of weight at such a low point and so far distant from the hands, and even further from the focal point of the stroke, once the stroke is initiated and the head is released the head is difficult to control and has a tendency to self-accelerate and take control of the stroke. In attempts to keep from bowing, bending, moving, twitching, quitting, and frustrating and undermining wrist-lock potential, the hands strain to counter-act the forces of the putter head once it is put into motion. Such attempts also often result in either hesitation or a pulling back on the stroke while still trying to attain and maintain wrist-lock potential. More often than not, the hands will wobble, wrist-lock potential is not attained or, if attained, is breeched, the shaft moves, and the stroke becomes jerky and less fluid. Even if the putter head remains aligned with the ball, the minute change in shaft position causes the ball to either push (travel slightly forward of the golfer and away from the hole) or pull (travel slightly to the back of the golfer and away from the hole). Other factors, such as tension, anxiety, nerves, and increased levels of adrenaline further exacerbate the problems generally associated with putting. Any one of these, coupled with the physical motions involved in attempting to execute a perfect putt, could adversely affect the stroke and the end result of the putt.

Attempts to correct this problem have included filling the shaft, from the tip up, with sand, BB's, and other particles. These attempts have failed to solve the problems addressed above. In all such cases, the golf putters have become much heavier than normal with no corresponding decrease in putter head weight, the true source of the problem. In some cases, the golf putter becomes noisy while being used as the weight shifts. All such attempts have adversely affected the balance, speed, and feel of the stroke and have failed to attain the desired wrist-lock potential or to cure the twitching, quitting, hesitating, and similar minute movements of the hands and wrists. Because the feel of the golf putter and the stroke have become altered, the golfer experiences an uncontrollable need to counteract the stroke before it is initiated. All these attempts have only worsened the end result of the putt.

Other enhancements to golf clubs in general have involved adding weight to a shaft while decreasing the weight in the head (Mather, et. al., U.S. Pat. No. 5,152,527); adding weight to golf club shafts without any change in weight to the club head (Benzel, U.S. Pat. No. 5,244,209; Mitchell, U.S. Pat. No. 4,461,479; and Karns, U.S. Pat. No. 3,075,768); adding adjustable weight to the outside of golf club shafts (Tanampai, U.S. Pat. No. 5,178,394; and Burnett, U.S. Pat. No. 3,680,870). While Mather ('527), Benzel ('209), Mitchell ('479), and Karns ('768) relate to golf clubs in general, they deal with power swings associated with full-swing clubs. Weight is added in relation to the force necessary to complete a full-swing and drive the ball farther upon being struck. Each addresses the full range of golf clubs upon which their respective concept could be used. Each, however, excludes the golf putter because the concepts associated with full-swing clubs are inappropriate to the fluid stroke integrally associated with a putt.

Mather ('527) calls for a corresponding decrease in club head weight as an absolute requirement for full optimization of the power swing at the point of uncocking of the wrists during a full swing at a ball. For golf clubs ranging in weight from 350 to 500 grams, after decreasing club head weight between 40 to 50 grams, respectively, Mather teaches to add between 80 to 160 grams, respectively, for an overall net weight increase to the golf club of 40 to 110 grams or 11.4% to 22%, respectively. The weight of the club head is decreased between 13% to 30%. These ranges, it is taught, will optimize the power of the swing at the phase where the wrists begin to uncock. None of the teachings addressed above is suited to the purpose, scope, function, and structure of a golf putter.

In addition to the physical aspects of golf, the game involves numerous psychological aspects. Emotional and visual distractions often affect the quality of play. Use of add-on weights on a putter, such as described by Tanampai ('394) and Burnett ('870), are a visual distraction to the most critical facet of the game. In addition, they can cause damage to the shaft. The proper balance necessary to attain wrist-lock potential cannot be established by using add-on weight. Such weights are unsightly and adversely affect the concentration of the golfer. The added weight, without a corresponding decrease to putter head weight, alters the feel, traditional speed, and play of the golf putter. With these alterations, the execution of the stroke is adversely altered. These add-on weights do nothing to diminish or prevent the twitching, quitting, and hesitations associated with putting and have not solved such problems during this critical phase of the game. They do not foster the attainment of wrist-lock potential which is critical to a successful putt. The concentration of such weights on the outside of a shaft without decrease in putter head weight lead to poor putts; greater (rather than less) head control; and generally an somewhat uncontrolled acceleration of the stroke. To attain the proper balance point using these add-on devices without affecting the feel and play of the golf putter requires that the add-on weight be situated on the shaft at a location where the hands grip the golf putter. This, of course, interferes with the hands' ability to grasp and grip the golf putter thereby frustrating the purpose for which the weight was intended; i.e., the golf putter cannot be used.

Moreover, these devices were primarily designed for full-swing clubs (woods and irons) for accommodating and enhancing a full-swing power stroke at the point of a swing when the wrists uncock and provide added force to the swing to drive the ball farther when struck. These devices were not designed for, nor can they be adapted for proper use on a golf putter such that fluidity of stroke is maintained.

My previously mention co-pending application (Ser. No. 08/415,137 filed on Mar. 31, 1995) solves the problems associated with putting by creating a golf putter with a predetermined additional weight of a predetermined length, at a predetermined location along the shaft of a golf putter and providing a putter head having a predetermined weight substantially less than the weight of a putter head in a conventional golf putter. In the proper proportions, that improved golf putter incorporated the intricate variables of balance point, center point of weight means, swingweight, and weight means in such a fashion as to attain and maintain wrist-lock potential and inhibit head control while preserving the feel, speed, and play associated with a conventional golf putter. The intricate interplay of the variables resulted in a substantial increase in the overall weight of the golf putter with a corresponding, yet drastic reduction in swingweight. The enhancements of that invention as it relates to golf putters, fosters a smooth, fluid, un-interrupted stroke for the duration of the putt.

It has since been discovered that these same characteristics (wrist-lock potential) are also attainable to varying degrees by using even less added weight than previously done while using varying head weights up to the head weight of a conventional putter. This scaled approach not only sustains wrist-lock but, with a "heavier head" in relation to the added weight, reintroduces an element of head control thereby "fictitiously" emulating the feel of a traditional putter. The psychology of that "feel" coupled with "wrist-lock" increases the efficiency of a stroke and putt.

SUMMARY OF THE INVENTION

The above-noted problems, and others, are overcome by the improved golf putter which is specially weighted to alter the balance point by increasing the overall weight of the golf putter whereby the ratio between the putter head and the overall weight and swingweight are altered such that wrist-lock potential is attained and maintained, and limited head control is reintroduced, for the duration of the putt. The improved golf putter includes a shaft with an inner chamber, a grip attached to the shaft from a butt-end downward, a putter head connected to the shaft at a tip, and an added weight of a predetermined amount situated along the shaft of the golf putter at a predetermined location based on the center point of the weight to add substantial weight to the overall weight of the improved golf putter as it relates to the overall weight of a conventional golf putter. Proper placement of the added weight is critical so that the balance point of the improved golf putter falls within certain predetermined ranges relative to the overall length of the golf putter. Such additional weight, properly placed, substantially increases the overall weight of the golf putter and drastically alters the putter-head-weight-to-overall-weight ratio while simultaneously and significantly altering its swingweight, thereby fostering wrist-lock potential and permitting limited head control.

For the purpose of this invention and only to better understand it and not limit it, the improved golf putter will be compared to a conventional golf putter. A conventional golf putter is about 30 to 40 inches in overall length and weighs between 450 and 520 grams. In a golf putter with a hosel, the shaft length is between 30 and 34 inches. Of the weight range described above, the putter head weighs between 300 and 340 grams, and miscellaneous matter which includes the shaft (between 85 and 95 grams), the grip (between 60 and 70 grams), and additional matter (between 5 and 15 grams) of between about 150 and 180 grams (average 165 grams). Median ranges of this conventional golf putter are being used in order to establish a relational base to the present invention (i.e., the conventional golf putter weighing about 485 grams overall of which the putter head weighs about 320 grams, the shaft about 90 grams, the grip about 65 grams, and miscellaneous matter about 10 grams; and being 35 inches in overall length and, in those golf putters with a hosel, having a 32-inch shaft). The weight ratio between putter head and overall weight in this conventional golf putter is 0.66:1. All length % used herein for relational purposes are compared to the overall length of the above-defined conventional putter; i.e., 35 inches. The balance point of this conventional golf putter is about 26 inches from the butt-end (74.3 length % from butt-end) and has a swingweight of about D-0.

In order to attain and maintain wrist-lock potential and head control, the improved golf putter can range in overall weight between about 505 and 1055 grams (by using a 240-gram weight head and adding 100 grams; and by using a 320-gram head and adding 570 grams, respectively); range in head-weight to added-weight ratio by between about 0.56:1 and 3.20:1; and ranges in head-weight to overall-weight ratio by between about 0.30:1 and 0.55:1. The added weight means should be positioned at a location such that the center point of the weight means is at a distance from the butt-end of the shaft between 20 and 71.4 length % of the overall length of the club (or between 7 and 25 inches therefrom relative to a 35-inch golf putter), resulting in a substantial alteration of the balance point (which in the conventional golf putter is 74.3 length % from the butt-end) and an alteration of the swingweight. Crucial to this inventive concept is, in relation to a conventional putter, to decrease the headweight-to-overall ratio and add weight in such a fashion as to alter the putter's balance point upward toward the butt-end.

By way of comparison and using the weights and measures of the above-defined conventional golf putter good results of wrist-lock and head control are achieved by using a putter head weight of about 240 grams, standard miscellaneous matter of about 165 grams, and adding weight of about 100 to 160 grams yielding a total weight of between about 505 and 565 grams. Using about 100 grams yields an increased weight (over the average weight [485 grams] of a putter) of about 4.1%; a head-weight to weight-means ratio of about 2.4:1; and a head-weight to overall-weight ratio of about 0.47:1. Placing the center point of the weight means at about 7 inches from the butt-end (20 length % from the butt-end) results in a balance point at about 21.38 inches from the butt-end (about 61.09 length % from the butt-end) and a swingweight of about negative B-7. Placing the center point of the same weight means at about 11 inches from the butt-end (31.4 length % from the butt-end) alters the balance to about 22.13 inches from the butt-end (about 63.23 length % from the butt-end) and changes the swingweight to about negative B-1. Moving the center point of the same weight means to about 15 inches from the butt-end (42.9 length % from the butt-end) shifts the balance point to about 22.81 inches from the butt-end (65.17 length % from the butt-end) and modifies the swingweight to about negative A-4.

Using about 160 grams yields an increased weight (over the average weight [485 grams] of a putter) of about 16.5%; a head-weight to weight-means ratio of about 1.5:1; and a head-weight to overall-weight ratio of about 0.42:1. Placing the center point of the weight means at about 7 inches from the butt-end (20 length % from the butt-end) results in a balance point at about 19.88 inches from the butt-end (56.80 length % from the butt-end) and a swingweight of about C-6. Placing the center point of the same weight means at about 11 inches from the butt-end (31.4 length % from the butt-end) alters the balance to about 20.88 inches from the butt-end (59.66 length % from the butt-end) and changes the swingweight to about negative B-4. Moving the center point of the same weight means to about 15 inches from the butt-end (42.9 length % from the butt-end) shifts the balance point to about 21.75 inches from the butt-end (62.14 length % from the butt-end) and modifies the swingweight to about negative A-3.

Similar wrist-lock and head control results also are achieved by using a putter head weight of about 320 grams, standard miscellaneous matter of about 165 grams, and adding weight of between about 100 and 570 grams yielding a total weight of between about 585 and 1055 grams. Using about 100 grams yields an increased weight (over the average weight [485 grams] of a putter) of about 20.6%; a head-weight to weight-means ratio of about 3.20:1; and a head-weight to overall-weight ratio of about 0.55:1. Placing the center point of the weight means at about 7 inches from the butt-end (20 length % from the butt-end) results in a balance point at about 23.19 inches from the butt-end (66.26 lengths from the butt-end) and a swingweight of about B-6. Placing the center point of the same weight means at about 11 inches from the butt-end (31.4 length % from the butt-end) alters the balance to about 23.75 inches from the butt-end (67.86 length % from the butt-end) and changes the swingweight to about C-4. Moving the center point of the same weight means to about 15 inches from the butt-end (42.9 length % from the butt-end) shifts the balance point to about 24.25 inches from the butt-end (69.29 length % from the butt-end) and modifies the swingweight to about D-0.

Using about 160 grams yields an increased weight (over the average weight [485 grams] of a putter) of about 33.0%; a head-weight to weight-means ratio of about 2.00:1; and a head-weight to overall-weight ratio of about 0.50:1. Placing the center point of the weight means at about 7 inches from the butt-end (20 length % from the butt-end) results in a balance point at about 21.69 inches from the butt-end (61.97 length % from the butt-end) and a swingweight of about A-9. Placing the center point of the same weight means at about 11 inches from the butt-end (31.4 length % from the butt-end) alters the balance to about 22.75 inches from the butt-end (65.0 length % from the butt-end) and changes the swingweight to about C-0. Moving the center point of the same weight means to about 15 inches from the butt-end (42.9 length % from the butt-end) shifts the balance point to about 23.50 inches from the butt-end (67.14 length % from the butt-end) and modifies the swingweight to about D-1.5.

Using about 570 grams yields an increased weight (over the average weight [485 grams] of a putter) of about 117.5%; a head-weight to weight-means ratio of about 0.56:1; and a head-weight to overall-weight ratio of about 0.30:1. Placing the center point of the weight means at about 7 inches from the butt-end (20 length % from the butt-end) results in a balance point at 16.00 inches from the butt-end (45.71 length % from the butt-end) and a swingweight of about negative E-9. Placing the center point of the same weight means at about 11 inches from the butt-end (31.4 length % from the butt-end) alters the balance to 18.25 inches from the butt-end (52.14 length % from the butt-end) and changes the swingweight to about negative A-4. Moving the center point of the same weight means to about 15 inches from the butt-end (42.9 length % from the butt-end) shifts the balance point to about 20.50 inches from the butt-end (58.57 length % from the butt-end) and modifies the swingweight to about D-6.

Better wrist-lock and head control results are achieved by using a putter head weight of between about 260 and 290 grams, standard miscellaneous matter of about 165 grams, and adding weight of between about 100 and 160 grams yielding a total weight of between about 525 and 615 grams. Using about 100 grams as the weight means with about a 260-gram putters head yields an increased weight (over the average weight [485 grams] of a putter) of about 8.2%; a head-weight to weight-means ratio of about 2.60:1; and a head-weight to overall-weight ratio of about 0.49:1. Placing the center point of the weight means at about 7 inches from the butt-end (20 length % from the butt-end) results in a balance point at about 21.81 inches from the butt-end (62.31 length % from the butt-end) and a swingweight of negative A-9. Placing the center point of the same weight means at about 11 inches from the butt-end (31.4 length % from the butt-end) alters the balance to about 22.63 inches from the butt-end (64.66 length % from the butt-end) and changes the swingweight to about negative A-2. Moving the center point of the same weight means to about 15 inches from the butt-end (42.9 length % from the butt-end) shifts the balance point to about 23.81 inches from the butt-end (68.01 length % from the butt-end) and modifies the swingweight to about A-5.

Using about 160 grams as the weight means with about a 260-gram putter head yields an increased weight (over the average weight [485 grams] of a putter) of about 20.6%; a head-weight to weight-means ratio of about 1.63:1; and a head-weight to overall-weight ratio of about 0.44:1. Placing the center point of the weight means at about 7 inches from the butt-end (20 length % from the butt-end) results in a balance point at about 20.38 inches from the butt-end (58.29 length % from the butt-end) and a swingweight of about negative B-7. Placing the center point of the same weight means at about 11 inches from the butt-end (31.4 length % from the butt-end) alters the balance to about 21.38 inches from the butt-end (61.09 length % from the butt-end) and changes the swingweight to about negative A-5. Moving the center point of the same weight means to about 15 inches from the butt-end (42.9 length % from the butt-end) shifts the balance point to about 22.25 inches from the butt-end (63.57 length % from the butt-end) and modifies the swingweight to about A-6.

Using about 100 grams as the weight means with about a 280-gram putter head yields an increased weight (over the average weight [485 grams] of a putter) of about 12.4%; a head-weight to weight-means ratio of about 2.80:1; and a head-weight to overall-weight ratio of about 0.51:1. Placing the center point of the weight means at about 7 inches from the butt-end (20 length % from the butt-end) results in a balance point at about 22.25 inches from the butt-end (63.57 lengths from the butt-end) and a swingweight of about negative A-1. Placing the center point of the same weight means at about 11 inches from the butt-end (31.4 length % from the butt-end) alters the balance to about 23.13 inches from the butt-end (66.09 length % from the butt-end) and changes the swingweight to about A-7. Moving the center point of the same weight means to about 15 inches from the butt-end (42.9 length % from the butt-end) shifts the balance point to about 23.56 inches from the butt-end (67.31 length % from the butt-end) and modifies the swingweight to about B-4.

Using about 160 grams as the weight means with about a 280-gram putter head yields an increased weight (over the average weight [485 grams] of a putter) of about 24.7%; a head-weight to weight-means ratio of about 1.75:1; and a head-weight to overall-weight ratio of about 0.46:1. Placing the center point of the weight means at about 7 inches from the butt-end (20 length % from the butt-end) results in a balance point at about 20.88 inches from the butt-end (59.66 length % from the butt-end) and a swingweight of about negative A-9. Placing the center point of the same weight means at about 11 inches from the butt-end (31.4 length % from the butt-end) alters the balance to about 21.88 inches from the butt-end (62.51 length % from the butt-end) and changes the swingweight to about A-4. Moving the center point of the same weight means to about 15 inches from the butt-end (42.9 length % from the butt-end) shifts the balance point to about 22.75 inches from the butt-end (65.0 length % from the butt-end) and modifies the swingweight to about B-5.

Using about 100 grams as the weight means with about a 290-gram putter head yields an increased weight (over the average weight [485 grams] of a putter) of about 14.4%; a head-weight to weight-means ratio of about 2.90:1; and a head-weight to overall-weight ratio of about 0.52:1. Placing the center point of the weight means at about 7 inches from the butt-end (20 length % from the butt-end) results in a balance point at about 22.50 inches from the butt-end (64.29 length % from the butt-end) and a swingweight of about A-3. Placing the center point of the same weight means at about 11 inches from the butt-end (31.4 length % from the butt-end) alters the balance to about 23.25 inches from the butt-end (66.43 length % from the butt-end) and changes the swingweight to about B-1. Moving the center point of the same weight means to about 15 inches from the butt-end (42.9 length % from the butt-end) shifts the balance point to about 23.75 inches from the butt-end (67.86 length % from the butt-end) and modifies the swingweight to about B-8.

Using about 160 grams as the weight means with about a 290-gram putter head yields an increased weight (over the average weight [485 grams] of a putter) of about 26.8%; a head-weight to weight-means ratio of about 1.81:1; and a head-weight to overall-weight ratio of about 0.47:1. Placing the center point of the weight means at about 7 inches from the butt-end (20 length % from the butt-end) results in a balance point at about 21.13 inches from the butt-end (60.37 length % from the butt-end) and a swingweight of about negative A-4. Placing the center point of the same weight means at about 11 inches from the butt-end (31.4 length % from the butt-end) alters the balance to about 22.06 inches from the butt-end (63.03 length % from the butt-end) and changes the swingweight to about A-8. Moving the center point of the same weight means to about 15 inches from the butt-end (42.9 length % from the butt-end) shifts the balance point to about 23.00 inches from the butt-end (65.71 length % from the butt-end) and modifies the swingweight to C-9.

Best results are achieved with about a 320-gram putter head and using between about 270 and 310 grams as the weight means. Using about 270 grams as the weight means with this putter head yields an increased weight (over the average weight [485 grams] of a putter) of about 55.7; a head-weight to weight-means ratio of about 1.19:1; and a head-weight to overall-weight ratio of about 0.42:1. Placing the center point of the weight means at about 7 inches from the butt-end (20 length % from the butt-end) results in a balance point at about 19.63 inches from the butt-end (56.09 length % from the butt-end) and a swingweight of about negative A-7. Placing the center point of the same weight means at about 11 inches from the butt-end (31.4 length % from the butt-end) alters the balance to about 20.94 inches from the butt-end (59.83 length % from the butt-end) and changes the swingweight to about B-3. Moving the center point of the same weight means to about 15 inches from the butt-end (42.9 length % from the butt-end) shifts the balance point to about 22.25 inches from the butt-end (63.57 length % from the butt-end) and modifies the swingweight to about D-2.

Using about 310 grams as the weight means with this putter head yields an increased weight (over the average weight [485 grams] of a putter) of about 63.9%; a head-weight to weight-means ratio of about 1.03:1; and a head-weight to overall-weight ratio of about 0.40:1. Placing the center point of the weight means at about 7 inches from the butt-end (20 length % from the butt-end) results in a balance point at about 18.94 inches from the butt-end (54.11 length % from the butt-end) and a swingweight of about negative B-4. Placing the center point of the same weight means at about 11 inches from the butt-end (31.4 length % from the butt-end) alters the balance to about 20.44 inches from the butt-end (58.4 length % from the butt-end) and changes the swingweight to about B-1. Moving the center point of the same weight means to about 15 inches from the butt-end (42.9 length % from the butt-end) shifts the balance point to about 21.94 inches from the butt-end (62.69 length % from the butt-end) and modifies the swingweight to about D-5.

Optimum results are achieved with about 290 grams as the weight means and about a 320-gram putter head. This putter configuration yields an increased weight (over the average weight [485 grams] of a putter) of about 59.8%; a head-weight to weight-means ratio of about 1.10:1; and a head-weight to overall-weight ratio of about 0.41:1. Placing the center point of the weight means at about 7 inches from the butt-end (20 length % from the butt-end) results in a balance point at about 19.25 inches from the butt-end (55.0 length % from the butt-end) and a swingweight of about negative B-0. Placing the center point of the same weight means at about 11 inches from the butt-end (31.4 length % from the butt-end) alters the balance to about 20.81 inches from the butt-end (59.46 length % from the butt-end) and changes the swingweight to about B-2. Moving the center point of the same weight means to about 15 inches from the butt-end (42.9 length % from the butt-end) shifts the balance point to about 22.06 inches from the butt-end (63.03 length % from the butt-end) and modifies the swingweight to about D-4.

The location for the center point of the added weight means for golf putters of greater or lesser lengths would be proportionally increased or decreased in distance from butt-end relative to increases or decreases in length of the golf putter. Proportionate weight increases and decreases must be made relative to weight changes. Weight ratios are crucial to the improved golf putter in attaining and maintaining wrist-lock potential and re-introducing limited head control. Absolute weight ratios between putter head and overall weight of this improved golf putter range between about 0.30:1 and 0.55:1. Absolute weight ratios between putter head and the added weight range between about 0.56:1 and 3.20:1 with the center point of the added weight placed between about 7 and 15 inches from the butt end. Good results are achieved with weight ratios between putter head and overall weight of the improved golf putter between about 0.40:1 and 0.55:1. Weight ratios between putter head and the added weight in this situation should be between about 1.03:1 and 3.20:1 with the center point of the added weight placed between about 7 and 15 inches from the butt end.

Better positive results are achieved with weight ratios between putter head and overall weight of the improved golf putter between about 0.40:1 and 0.52:1. Weight ratios between putter head and the added weight in this situation should be between about 1.03:1 and 2.90:1 with the center point of the added weight placed between about 7 and 15 inches from the butt end. Best results are achieved with weight ratios between putter head and overall weight of the improved golf putter between about 0.40:1 and 0.42:1. Weight ratios between putter head and the added weight in this situation should be between about 1.03:1 and 1.19:1 with the center point of the added weight placed between about 7 and 15 inches from the butt end. Optimum results are achieved by using a putter with about a 320-gram putter head and adding about 290 grams the shaft such that the center point of the added weight is about 11 inches from the butt-end. This yields a weight ration between putter head and overall weight of about 0.41:1 and a weight ratio between putter head and added weight means of about 1.10:1. This also alters the balance point to 20.81 inches (59.46 length % from the butt-end) yielding a swingweight of B-2.

Accordingly, several objects and advantages of our invention are to:

increase the fluidity and continuity of a putting stroke;

attain and maintain wrist-lock potential for the duration of the stroke;

re-introduce limited head control to the stroke;

counter-balance the putter head weight and butt-end weight in such a manner that neither the putter head nor the butt-end weight takes total control of the stroke;

counter the physical impediments to the successful completion of a smooth stroke;

maintain the shoulders as the fulcrum and primary force pushing a putt;

neutralize voluntary and involuntary wrist movement during the execution of a putt;

maintain the expected feel and speed as that of a conventional golf putter; and improve the general mechanics of a putting stroke.

Other objects and features of the invention will become apparent as the drawings which follow are understood by reading the corresponding description thereof.

BRIEF DESCRIPTION OF THE DRAWING FIGURES

DESCRIPTION OF THE PREFERRED EMBODIMENTS

Figure 1:
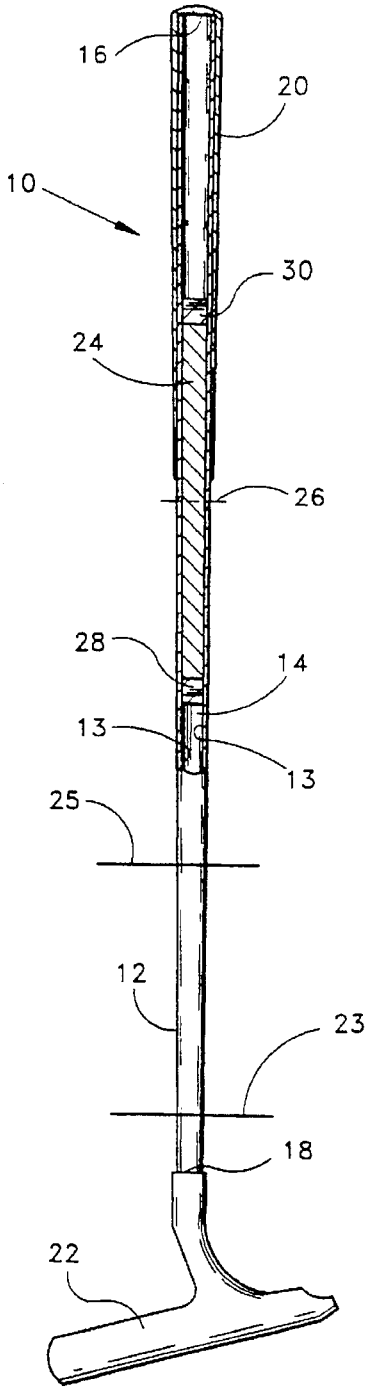
FIG. 1 is an elevation view, partially cut-away axially, of the golf putter of this invention having an internal weight means.

FIG. 1 is an elevation view and, for clarity, is not to scale. It reveals an axial partial cut-away cross section of golf putter 10. Golf putter 10 has a generally tubular, shaft 12. Shaft 12 can be tapered, parallel, or any combination thereof. Shaft 12 has inner chamber 14, butt-end 16 and tip 18. Inner chamber 14 has walls 13. From butt-end 16 to tip 18, in this embodiment, shaft 12 is tapered. Grip 20 is attached at, and downward the butt-end 16 of shaft 12. Putter head 22 is connected to tip 18 of shaft 12. Weight means 24 is situated in inner chamber 14. First 28 and second 30 plug fixedly engage walls 13 and rest on opposing sides of weight means 24 to securely hold the weight means 24 in place. Plugs 28 and 30 are a material of a substantial low density, such as, but not limited to cork, or other similar material suited for the intended purpose. A single plug or more plugs may be used depending upon materials selected. If a single plug is used, it should be placed in the position of first plug 28. Weight means 24 has center point 26 which denotes the point at which the weight is equal on either side thereof. Weight means 24 can consist of a single piece or a plurality of pieces. Material for weight means 24 includes, but is not limited to, lead, copper, brass, zinc, steel, depleted uranium, and mixtures thereof; or other material of sufficient density suited for the intended purpose. Optimum results are achieved with lead because of its cost, malleability, availability, and density. Lead provides the best weight means for proper length, center point, balance point, and distance from butt-end to achieve the proper swingweight and to consistently establish and maintain the desired wrist-lock potential while putting. Balance points 23 and 25 reflect differing locations and points in between as weight means and center point are altered.

Figure 2:
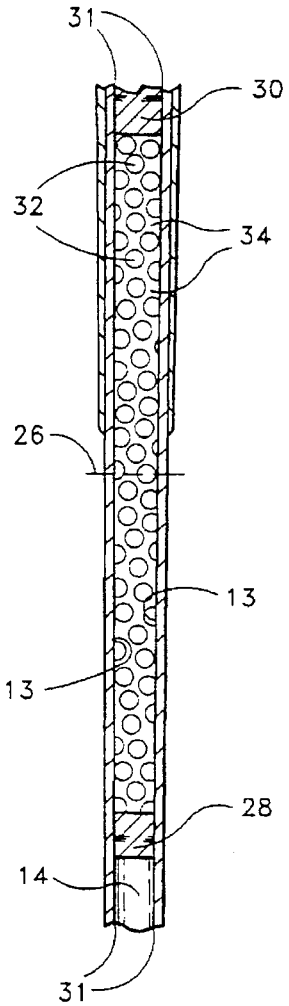
FIG. 2 is a cross-section view showing an alternate internal weight means structure of this invention.

FIG. 2 is an axial cross-section view showing an alternate for weight means 24. Weight means 24 here comprises a plurality of small particles 32 held in place by first 28 and second plugs 30 each of which fixedly abut walls 13 of inner chamber 14. Small particles 32 include, but are not limited to, BB's, lead, copper, brass, zinc, steel, depleted uranium, and mixtures thereof; or other material of sufficient density suited for the intended purpose. Small particles 32 may gravitationally abut one another or be engulfed by securing compound 34 so that they may be held in place. Securing compound 34, if used, seals points 31, points at which first 28 and second 30 plugs abut walls 13 of inner chamber 14. Securing compound 34 holds small particles 32 and first 28 and second 30 plugs securely in place and provides cushion support for small particles 32 inside inner chamber 14 thereby facilitating a smooth stroke when putting. Securing compound 34 comprises, but is not limited, to natural, synthetic rubber, epoxy, polyester, resin, and mixtures thereof; or other compounds suited for the intended purpose.

Weight means 24 can be a fluid or liquid of sufficient density suited for the purpose intended. Such fluid includes, but is not limited to high-density oils, mixtures of high-density oils and other liquids or solid particles, and combinations thereof. Securing compound 34 is suited to act as a sealant around plugs 28 and 30 to prevent fluid within from leaking into shaft 12.

Figure 3:
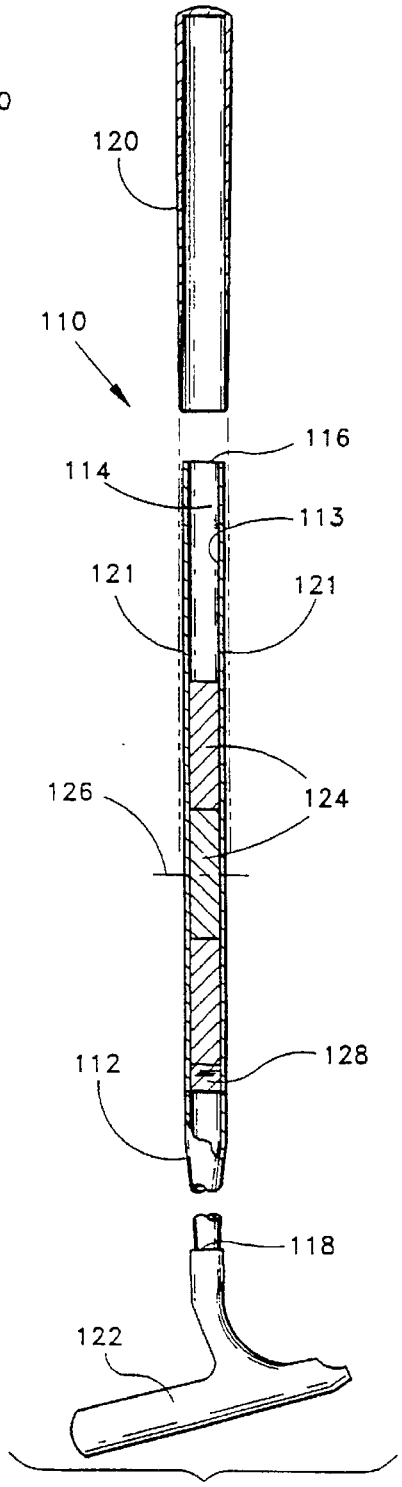
FIG. 3 is an exploded elevation view, partially cut-away axially, of an alternate embodiment of the golf putter.

FIG. 3 is an exploded elevation, axial cut-away, view of an alternate assembly golf putter 110. Shaft 112 has inner chamber 114, butt-end 116, and tip 118. Putter head 122 is connected to tip 118. Grip 120 attaches to shaft 112. Inner chamber 114 has walls 113. In this embodiment, shaft 112 has substantially parallel sides 121 which extend from butt-end 116 to a point distal to single plug 128. In the preferred embodiment of golf putter 110, the length of shaft 112 is approximately 32 inches and the overall length of golf putter 110 is 35 inches. The length of parallel sides 121 is approximately 16 inches. Parallel sides 121 can run the full length of shaft 112. Weight means 124 also can be a single piece or a plurality of pieces. Center point 126 of weight means 124 is the point at which the weight of weight means 124 is equal on either side of center point 126. Weight means 124 can be of any material suited to the intended purpose including, but not limited to lead, copper, brass, zinc, steel, and depleted uranium, and mixtures thereof; or other material of sufficient density suited for the intended purpose. In this preferred embodiment, center point 126 of weight means 124 is approximately 11 inches from butt-end 116. The overall length of weight means 124 in this embodiment is approximately 7¾ inches and is of sufficient width, diameter, or perimeter such that it substantially fills walls 113 of inner chamber 114. Single plug 128 is situated in shaft 112 and secures weight means 124 in place.

The location for center point 126 of weight means 124 for golf putters of greater or lesser lengths would be proportionally increased or decreased in distance from butt-end 116 relative to increases or decreases in length of the golf putter. Proportionate weight increases and decreases should be made relative to weight changes. Weight ratios (putter-head-weight to overall-weight and putter-head-weight to weight-means) and balance points are crucial to this improved golf putter in attaining and maintaining wrist-lock potential while simultaneously permitting limited head control.

In golf putter 110 depicted above with shaft 112 having a length of approximately 32 inches (overall golf putter length of 35 inches, overall golf putter weight 485 grams) optimum results are achieved by attaching to shaft 112 putter head 122 having a weight of approximately 320 grams (about equal in weight to the weight of a conventional golf putter) and adding weight means of approximately 290 grams, for a net weight gain of about 290 grams or approximately 59.8 weight % over that of the pre-defined conventional golf putter. This example yields a weight ratio between putter head and overall weight of improved golf putter of about 0.41:1 and a weight ratio between putter head and added weight means of about 1.10:1. Center point 124 for the added weight (weight means) is about 11 inches (31.4 length %) from butt-end 116. This embodiment facilitates execution of a more perfect putt by altering the balance point upward closer to butt-end 116 on shaft 112, or to about 20.81 inches (59.46 length %) from the butt-end, where the golfer's hands attempt to hold the golf putter firm and steady yet simultaneously permits some head control. This achieves a swingweight of B-2, best suited for optimal wrist-lock potential and limited head control.

These proportions relieve hand tension caused by using a conventional putter with its weight being fully concentrated in the putter head and distribute more weight closer to the gripping and controlling region of the golf putter, thereby bringing the balance point closer to the focal point of the stroke and permitting some limited head control to effectively emulate the "feel" of a conventional putter but maintain wrist-lock potential. By altering the balance point as such and attaining the optimal swingweight, wrist-lock potential is attained and maintained thereby fostering a smooth, fluid, and un-interrupted stroke.

While specific embodiments of the improved golf putter have been shown and fully explained above for the purpose of illustration, it should be understood that many other uses will be found for the instant invention disclosure and many alterations, modifications, and substitutions may be made thereto without departing from the spirit and scope of the invention as defined by the appended claims. Such are intended to be included within the scope of the invention. Accordingly, the scope of the invention should be determined not by the embodiments illustrated, but by the appended claims and their legal equivalents.

The invention claimed is:

1. An improved golf putter comprising:

a shaft having an inner chamber, a butt-end, and a tip;

a grip attached to the butt-end of said shaft;

a weight means along said shaft, said weight means having a predetermined center point, said center point positioned along said shaft between 20 and 71.4 length % from said butt-end relative to an overall length of said improved golf putter; and a putter head connected to the tip of said shaft, said putter head bearing a weight ratio to said weight means ranging between 0.56:1 and 3.20:1 and a weight ratio to an overall weight of said improved golf putter ranging between 0.30:1 and 0.55:1, which after all elements are connected and attached presents a specific balance point for said improved golf putter ranging between 45.71 and 69.29 length % from said butt-end relative to the overall length of said golf putter and a swingweight between D-6 and negative E-9, whereby, said putter head and said weight means so ratioed in weight and said weight means so positioned, provides a counterweight to the weight of said putter head of said improved golf putter and provides for some head control when stroking a putt.

2. The invention as described in claim 1 wherein said weight means is situated inside said shaft adjacent to the walls of the inner chamber.

3. The invention as described in claim 2 wherein said weight means comprise a material selected from the group consisting of lead, copper, brass, zinc, steel, depleted uranium, and mixtures thereof; and a first plug on the distal side of said material.

4. The invention as described in claim 3 wherein said weight means comprise at least one solid piece.

5. The invention as described in claim 3 wherein said weight means comprise a plurality of small particles.

6. The invention as described in claim 3 wherein the overall length of said improved golf putter is between about 30 and 40 inches, said shaft is between about 30 and 34 inches in length, said putter head weighs between about 240 and 320 grams, said weight means weighs between about 100 and 570 grams and its center point is situated in said shaft is between about 20 and 42.9 length % from the butt-end of said improved golf putter, the overall weight of the improved golf putter ranges from between about 505 and 1055 grams.

7. The invention as described in claim 3 wherein the overall length of said improved golf putter is about 35 inches, said shaft is about 32 inches in length, said putter head weighs between about 280 grams and 320 grams, said weight means weighs between about 270 and 310 grams and its center point is situated in said shaft between about 7 and 15 inches from the butt-end of said improved golf putter, said balance point is between about 18.13 and 22.25 inches from the butt-end of said improved golf putter, the overall weight of the improved golf putter is between about 715 and 795 grams, and its swingweight is between about D-0 and negative D-5.

8. The invention as described in claim 3 wherein the overall length of said improved golf putter is about 35, said shaft is about 32 inches in length, said putter head weighs about 320 grams, said weight means weighs about 290 grams and its center point is situated in said shaft about 11 inches from the butt-end of said improved golf putter, said balance point is about 23.81 inches from the butt-end of said improved golf putter, the overall weight of the improved golf putter is about 775 grams, and its swingweight is about negative B-2.

9. The invention as described in claim 2 wherein said weight means comprise a securing compound selected from the group consisting of natural rubber, synthetic rubber, epoxy, and polyester resin suited to secure said weight means and said first plug to the walls.

10. The invention as described in claim 2 wherein said weight means comprise a fluid, a first and a second plug on opposing sides of said fluid, and sealing points at said first and second plugs.

11. The invention as described in claim 10 wherein said fluid comprises fluid selected from the group consisting of high density oils, mixtures of high-density oils and other liquids, mixtures of high-density oils and solid particles, and combinations thereof.

12. The invention as described in claim 10 wherein said sealing points are secured to said walls by a securing compound selected from the group consisting of natural rubber, synthetic rubber, epoxy, and polyester resin suited to secure said weight means to the walls and to said first and second plug.

13. The invention as described in claim 1 wherein said shaft is substantially tapered.

14. The invention as described in claim 1 wherein said shaft is cylindrical.

15. The invention as described in claim 1 wherein the center point of said weight means ranges between about 20 and 42.9 length % from said butt-end relative to the overall length of said improved golf putter, said balance point ranges between about 54.11 and 69.29 length % from said butt-end relative to the overall length of said improved golf putter, the weight ratio between said putter head and said weight means ranges between about 1.03:1 and 3.20:1, the weight ratio between said putter head and the overall weight of said improved golf putter ranges between about 0.40:1 and 0.55:1, and the swingweight ranges between about D-5 and negative C-6.

16. The invention as described in claim 1 wherein the center point of said weight means ranges between about 20 and 42.9 length % from said butt-end relative to the overall length of said improved golf putter, said balance point ranges between about 54.11 and 63.57 length % from said butt-end relative to the overall length of said improved golf putter, the weight ratio between said putter head and said weight means ranges between about 1.03:1 and 1.19:1, the weight ratio between said putter head and the overall weight of said improved golf putter ranges between about 0.40:1 and 0.42:1, and the swingweight ranges between about D-5 and negative B-4.

17. The invention as described in claim 1 wherein the center point of said weight means ranges between about 20 and 42.9 length % from said butt-end relative to the overall length of said improved golf putter, said balance point ranges between about 55.0 and 63.03 length % from said butt-end relative to the overall length of said improved golf putter, the weight ratio between said putter head and said weight means is about 1.10:1, the weight ratio between said putter head and the overall weight of said improved golf putter is about 0.41:1, and the swingweight ranges between about negative B-0 and D-4.

18. The invention as described in claim 1 wherein the center point of said weight means is situated approximately 31.4 length % from said butt-end relative to the overall length of said improved golf putter, said balance point is approximately 59.46 length % from said butt-end relative to the overall length of said improved golf putter, the weight ratio between said putter head and said weight means is about 1.10:1, the weight ratio between said putter head and the overall weight of said improved golf putter is about 0.41:1, and the swingweight is about B-2.

* * * * *